US005263259A

United States Patent [19]

Cimador

[11] Patent Number: 5,263,259

[45] Date of Patent: Nov. 23, 1993

[54] DESIGN APPARATUS

[76] Inventor: Fausto Cimador, 1015 Sound Dr. P.O. Box #51, Greenport, N.Y. 11944

[21] Appl. No.: 892,362

[22] Filed: Jun. 2, 1992

Related U.S. Application Data

[63] Continuation-in-part of Ser. No. 701,690, May 14, 1991, Pat. No. 5,121,552.

[51] Int. Cl.[5] ..... B43L 13/00

[52] U.S. Cl. ..... 33/41.4

[58] Field of Search ..... 401/35, 34, 48; 33/18.1, 41.1, 41.4

[56] References Cited

U.S. PATENT DOCUMENTS

| | | | |
|---|---|---|---|
| 243,255 | 6/1981 | Hepp | 33/41.1 |
| 1,559,089 | 10/1925 | Hagan et al. | 33/41.4 |
| 2,498,105 | 2/1950 | Dolan | 401/48 |

FOREIGN PATENT DOCUMENTS

| | | | |
|---|---|---|---|
| 7224 | 4/1902 | Austria | 33/41.4 |
| 1013219 | 4/1952 | France | 33/41.1 |
| 1186119 | 4/1970 | United Kingdom | 401/48 |

*Primary Examiner*—Thomas B. Will

*Attorney, Agent, or Firm*—Bauer & Schaffer

[57] ABSTRACT

A body having a pair of holes is provided to hold a pair of pencils or the like. The bores are provided with a threaded interior surface into which the instrument may be screwed and held.

4 Claims, 1 Drawing Sheet

DESIGN APPARATUS

RELATED APPLICATION

The present invention is a continuation-in-part of my copending application, Ser. No. 701,690, filed May 14, 1991, now U.S. Pat. No. 5,121,552 for which all benefit under 35 U.S.C. 120 is claimed.

BACKGROUND OF THE INVENTION

In my copending application I have disclosed apparatus for drawing complex geometric and graphic designs. Briefly, the apparatus comprises a plurality of transparent geometric templates having orthogonally oriented indicia and a drawing pad having one or more pairs of perpendicularly intersecting guide lines thereon so that orthogonal indicia of the templates may be aligned with the guide lines on said drawing pad and traced successively so as to generate complex composite and orthogonally oriented geometric patterns. In addition, a double pencil holder is provided for securing two pencils, pens, or the like substantially parallel to one another. The double pencil holder comprises a body having a pair of spaced parallel bores, each being of sufficient dimension to allow the force fitting of a pencil therein. When a drawing is traced with a pair of pencils in the holder and the holder orientation is held constant, the pencils will generate a primary and a secondary outline so as to give three-dimensional effect to the traced pattern.

It is the object of the present invention to provide improvement in the double pencil holder so as to provide a more secure holding of the pencils therein and to enable the user to more accurately and securely complete complex drawings.

It is a particular object to provide a double pencil holder which may be easily and effectively used with the template arrangement described above or without any template or other drawing aid.

This objects as well as others objects and advantages will be apparent from the foregoing disclosure of the present invention.

SUMMARY OF THE INVENTION

According to the present invention, the double pencil holder comprises a body having a pair of spaced parallel bores into each of which a pencil or similar writing instrument is force fit. Each bore is formed with a helical thread on the inner surface having a pitch allowing the writing instrument to be screwed into the hole and to be held by sufficient number of thread turns, in a secure and otherwise fixed manner during use.

The threads have a crest height and a valley depth permitting the thread to bite into the surface of the writing instrument to secure the instrument. Although this would score the writing instrument, it is of no difficulty or consequence since most drawing instruments have wooden bodies and are expendable. Nonwood writing instruments may be force fit into the holes, although it may be desirable to provide nonwood instruments with exterior threads.

Preferably, the double pencil holder of the present invention is formed (by working, molding, or otherwise) of a hard, rigid elastomeric material, which is enabled to have a small degree of distention so as to accommodate variations in the size of the writing instrument without undue elasticity or flexibility.

Full details of the present invention are set forth in the following description and are illustrated in the accompanying drawings.

DESCRIPTION OF THE INVENTION

Figure 1:
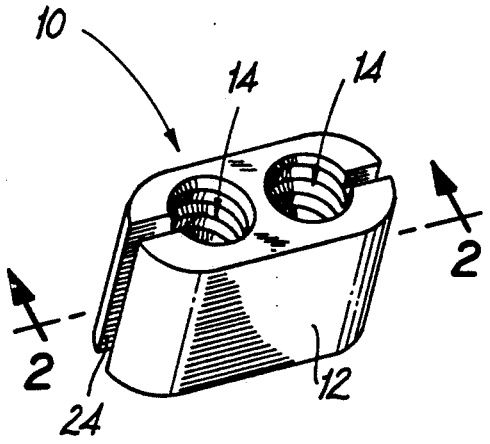
FIG. 1 is a perspective view of the double pencil holder of the present invention.
Figure 2:
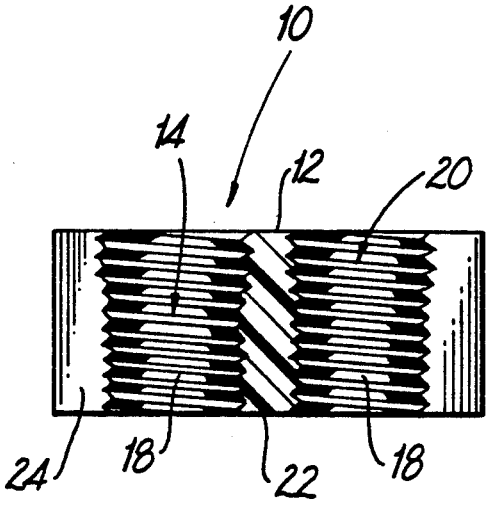
FIG. 2 is a sectional view of the double pencil holder taken along line 2—2 of FIG. 1.
Figure 3:
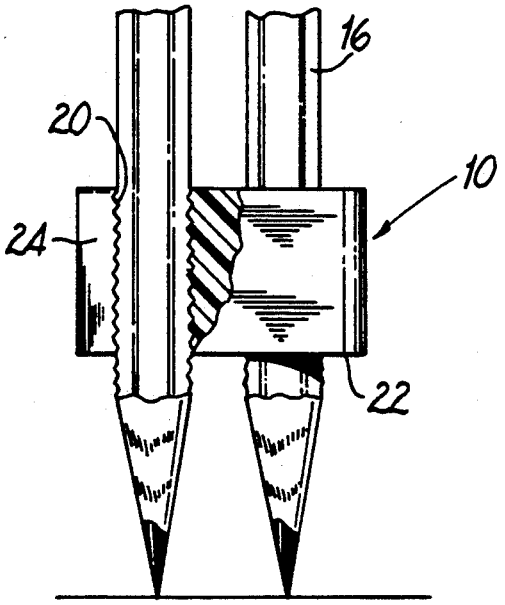
FIG. 3 is a partially sectioned elevational view of the double pencil holder with pencils inserted therein.

In the following description reference may be made to the template, pencil holder, and other means described in my copending application Ser. No. 701,690 now U.S. Pat. No. 5,121,552. Accordingly, it is to be understood that the contents of the aforementioned application is incorporated herein as if more fully set forth.

As seen in the Figures, the double pencil holder of the present invention generally depicted by the numeral 10 comprises a body 12 of substantially rigid material, preferably of a plastic, hard rubber and the like, although wood and metal may be used. The body 12 is provided with a pair of identical and parallel spaced holes 14 into which a pencil 16 or similar writing instrument would normally fit under frictional engagement. The inner wall of each hole is formed with a helical thread 18 having an overall pitch providing several turns along the axial length of the hole. The helix may be of uniform pitch; however, it is preferred that the initial few turns at the top or pencil entrance end, indicated by the numeral 20, be somewhat larger to facilitate the introduction of the pencil 16 as well as provide a lead for screwing the pencil into the hole. The tighter thread pitch at the lower or point end 22 of the hole will act to sufficiently secure the pencil in place.

The diameters of the crest and valleys of the thread are forms to enable the thread to cut into the surface of pencil 16, thereby grabbing or boring into the pencil for at least a substantial distance within the hole 14.

The size of the hole, thread pitch, and diameters is not critical provided that a writing instrument of corresponding shape and diameter be used. Of course, double pencil holders can be formed of a variety of sizes to match and mate with a corresponding variety of writing instruments.

In order to enable individual double pencil holders to accept writing instruments of nonuniform thickness, it may be desirable to provide a longitudinal slot 24 in the side walls of the body adjacent each hole 14, the slots run the entire length of the body form the top end 20 to the bottom end 22 and transversely from the outer surface into the holes 14. Thus, nonuniformly shaped writing instruments or instrument slightly larger than would normally correspond to the holder could be inserted and held by the elasticity and memory of the holder.

Figure 4:
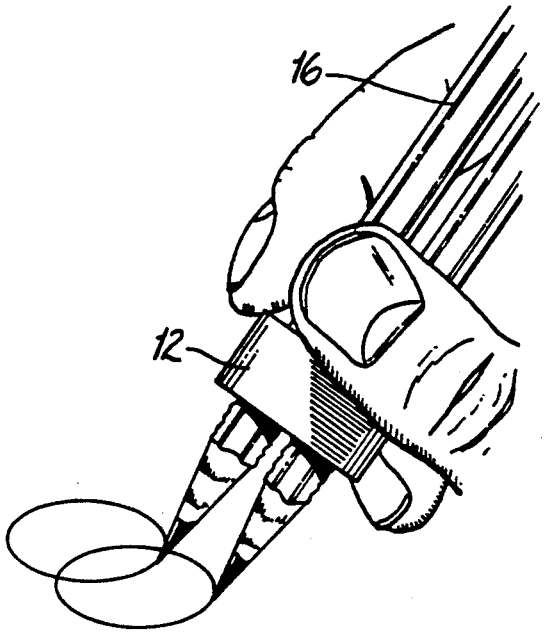
FIG. 4 is a perspective view showing the double pencil in use.

With two pencils installed into the double pencil holder 10, as seen in FIG. 4, the holder is capable of being securely held at the constant angle necessary to trace any design on paper or other planar sheet with both primary image as well as a secondary image slightly offset in position from the template outline. The user can easily manipulate the holder so that the lines of each image are parallel for forming a relative offset arrangement, as reference to my earlier application will show.

While the above description contains many specificities, these should not be construed as limitations on the scope of the instant invention but rather as an exemplification of the preferred embodiment thereof. Accordingly, the scope of the instant invention should not be determined by the embodiment shown but rather by the claims appended hereto.

What is claimed is:

1. A holder for securing two pencils in parallel position to each other so as to enable said pencils to draw two lines simultaneously comprising a body having a pair of parallel bores, said body being formed of a substantially rigid elastomeric material adapted to forcibly hold within each of said bores a writing instrument, each said bore being threaded on its inner surface said thread being sufficiently deep to secure the writing instrument in fixed position therein, the first turns in said threads having a greater pitch than the remaining turns.

2. The holder according to claim 1, wherein the thread in each bore is a continuous helix.

3. The holder according to claim 2, wherein the helix is of a pitch to provide a plurality of turns with said bore.

4. The holder according to claim 1, wherein said body is provided with axially extending slits from the outer surface into said bores to enable distention of said bores.

* * * * *